United States Patent [19]

Gardner

[11] 4,320,867

[45] Mar. 23, 1982

[54] PARTITION STRUCTURE

[75] Inventor: Jeffrey M. Gardner, Wheaton, Ill.

[73] Assignee: Container Corporation of America, Chicago, Ill.

[21] Appl. No.: 165,841

[22] Filed: Jul. 7, 1980

[51] Int. Cl.[3] ..... B65D 5/48

[52] U.S. Cl. ..... 229/42; 217/30

[58] Field of Search ..... 229/42, 15; 217/30, 217/7, 8

[56] References Cited

U.S. PATENT DOCUMENTS

| | | | |
|---|---|---|---|
| 2,605,039 | 7/1952 | Deline | 229/42 |
| 3,327,919 | 6/1967 | Kim | 229/42 |
| 3,640,445 | 2/1972 | Durham | 229/42 |
| 3,702,170 | 11/1972 | Adams | 229/42 |
| 3,912,159 | 10/1975 | Danville | 229/15 |
| 4,157,156 | 6/1979 | Skaggs | 229/15 |

*Primary Examiner*—Herbert F. Ross

*Attorney, Agent, or Firm*—R. W. Carpenter; Davis Chin

[57] ABSTRACT

A partition structure formed from a single cut and scored blank which is folded and erected to provide cells within a shipping container.

3 Claims, 3 Drawing Figures

PARTITION STRUCTURE

BACKROUND OF THE INVENTION

1. Field of the Invention

The invention structure is primarily adapted to the packaging of smaller containers formed of resinous materials such as blow moulded containers. These do not have to be completely isolated from each other, but a certain amount of restraint against shifting within an outer container must be provided.

Since such outer shipping containers alone may not have sufficient stacking strength it is desirable that the dividers between the resinous containers provide the necessary stacking strength of the loaded container.

2. The Prior Art

U.S. Pat. Nos. Kim 3,327,919 and Danville 3,912,159 are examples of partition structures formed from a single blank. Kim, however, achieves but a very specific form of structure incapable of variation by extra panel elements providing additional compartments. Danville achieves the partition structure by a common fold line joining first and second panels with flaps foldable therefrom. Upon initial folding to erected position the structure would tend to revert to the unfolded condition.

SUMMARY OF THE INVENTION

The partition structure is characterized by being formed from a single blank with a series of panel elements connected to bottom connector panels maintaining each series spaced from the other to maintain therebetween spaces for smaller containers. The bottom connector panels have the panel elements upstanding therefrom without the need for locking tabs and slots to maintain them in position.

THE DRAWING

DESCRIPTION

Figure 2:
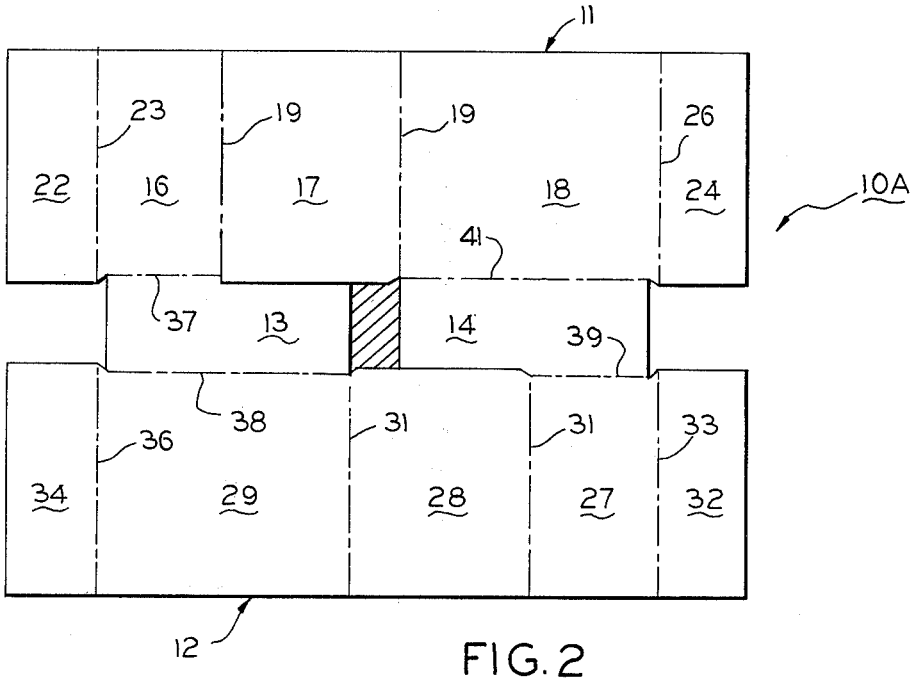
FIG. 2 is a plan view of a cut and scored blank for forming the structure of FIG. 1.

The partition structure is denoted by the reference numeral 10 and is formed from a cut and scored blank 10A of paperboard or the like. Blank 10A comprises a first series 11 of panel elements, and a second series 12 of panel elements, the two series being foldably joined to connector panels 13 and 14 spaced longitudinally of blank 10A and midway thereof.

First series 11 includes a first panel element 16, a second panel element 17 and a third panel element 18, these being joined by parallel fold lines 19. Panel elements 16 and 18 are foldably connected respectively to partition flaps 22 and 24 along fold lines 23 and 26.

In like fashion second series 12 includes a first panel element 27, a second panel element 28 and a third panel element 29, these being connected along parallel fold lines 31. Panel elements 27 and 29 are foldably connected respectively to partition flaps 32 and 34 along fold lines 33 and 36.

It will be observed that the two series 11 and 12 are in reverse image relationship.

The two connector panels 13 and 14 maintain connection between series 11 and 12, panel 13 being foldably connected to penel element 16 along fold line 37 and to panel element 29 along a fold line 38. Panel 14 is foldaby connected to panel element 27 along a fold line 39 and to panel element 18 along a fold line 41.

Figure 1:
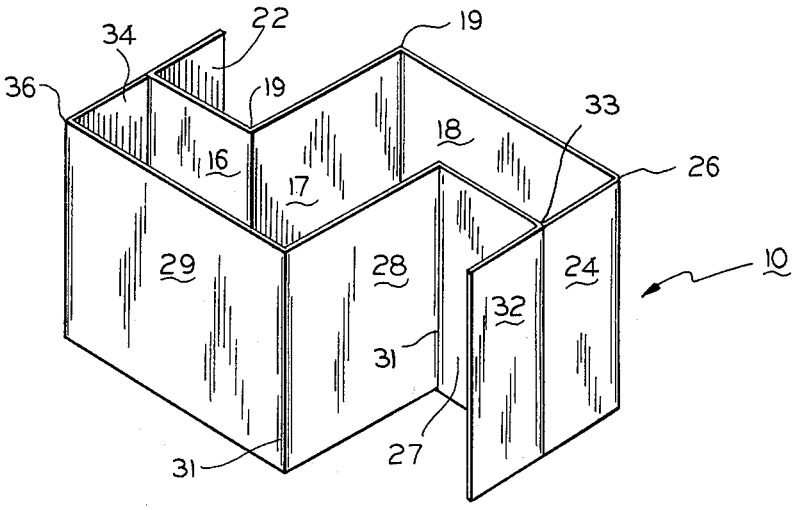
FIG. 1 is an isometric view of a partition structure according to the present invention.
Figure 3:
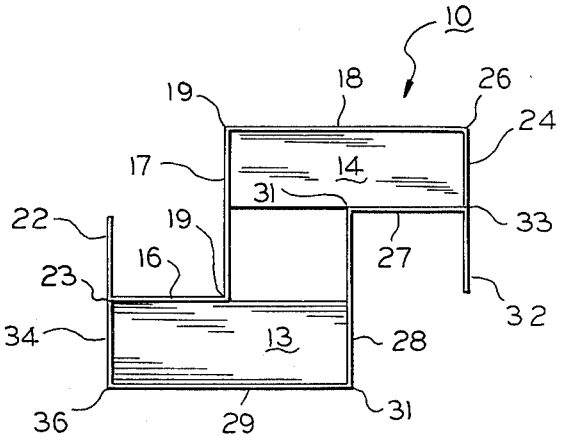
FIG. 3 is a top plan view of the structure seen in FIG. 1.

To set up the partition structure seen in FIGS. 1 and 3 the series 11 and 12 are erected with respect to the connector panels 13 and 14 about the fold lines 37, 38, 39 and 41. Series 11 is folded about the fold lines 19 of panel element 17 to cause the lower extremities of panel 17 to abut the end of connector panel 14. Concomitantly, series 12 is folded about fold lines 31 of panel 28 to cause the lower extremities of panel 28 to abut the end of connector panel 13.

It will be seen that the connector panels are each connected to proximate ends of the first and third panels of the opposed series 11 and 12.

It should be noted that the length of panel elements 17 and 28 is greater than the length of the panel elements flanking same so as to cause panel elements 17 and 28 to bear against the ends of the connector panels 13 and 14.

As seen in FIG. 3 the flaps 22 and 32 can be folded at right angles to their respective panel elements 16 and 18. In same fashion flaps 24 and 34 can be folded at right angles to their respective panel elements 18 and 29. In each case elements are provided for additional separation.

I claim:

1. A partition structure adapted to be disposed in a shipping container for effecting separation of product therein and providing stacking strength of a loaded container, said structure being formed from a cut and scored blank of paperboard and comprising:

(a) a first series of panel elements connected along parallel score lines;

(b) a second series of panel elements connected along parallel score lines;

(c) each of said series of panel elements having at least three foldably connected panel elements;

(d) a pair of connector panels spaced longitudinally of said blank midway thereof and foldably connected to said first and second series of panel elements at proximate ends of first and third of the panel elements thereof on fold lines which are off-set from inner edges of second panel elements, said connector panels being spaced from each other in a parallel relationship to form a center cell whose interior is generally of a reverse Z shape;

(e) said first and second series of panel elements being connected to said connector panels in reverse image relationship with the first and third panel elements connected to said connector panels in the aforesaid reverse image relationship;

(f) each of said series of panel elements being foldable with respect to the fold lines therein to cause the second panel to move into engagement with an end of a correlative connector panel.

2. A partition structure according to claim 1 wherein said second panel element is unconnected to a connector panel and has a longitudinal dimension greater than the longitudinal dimensions of the first and third panel elements to cause the second panel element to have bearing against the connector panel.

3. A partition structure according to claim 1 wherein said first and third panel elements are provided with partition flaps foldable with respect thereto.

* * * * *